US009771551B2

(12) United States Patent
Cermenati et al.

(10) Patent No.: US 9,771,551 B2
(45) Date of Patent: Sep. 26, 2017

(54) LIQUID CLEANING COMPOSITION WITH ABRASIVES

(71) Applicant: The Procter & Gamble Company, Cincinnati, OH (US)

(72) Inventors: Laura Cermenati, Brussels (BE); Marina Jozefa Hermie, Hever (BE); James Robert Tinlin, Brussels (BE)

(73) Assignee: The Procter & Gamble Company, Cincinnati, OH (US)

( * ) Notice: Subject to any disclaimer, the term of this patent is extended or adjusted under 35 U.S.C. 154(b) by 543 days.

(21) Appl. No.: 14/282,245

(22) Filed: May 20, 2014

(65) Prior Publication Data

US 2014/0352723 A1 Dec. 4, 2014

(30) Foreign Application Priority Data

May 29, 2013 (EP) ..... 13169641

(51) Int. Cl.

| | |
|---|---|
| ***C11D 17/00*** | (2006.01) |
| ***C11D 1/66*** | (2006.01) |
| ***C11D 1/83*** | (2006.01) |
| ***C11D 1/835*** | (2006.01) |
| ***C11D 1/86*** | (2006.01) |
| ***C11D 1/94*** | (2006.01) |
| ***C11D 3/14*** | (2006.01) |
| ***C11D 3/20*** | (2006.01) |

(52) U.S. Cl.

CPC ..... *C11D 17/0004* (2013.01); *C11D 1/66* (2013.01); *C11D 1/83* (2013.01); *C11D 1/835* (2013.01); *C11D 1/86* (2013.01); *C11D 1/94* (2013.01); *C11D 3/14* (2013.01); *C11D 3/2075* (2013.01)

(58) Field of Classification Search

CPC ..... C11D 17/0013; C11D 3/14; C11D 3/3715
See application file for complete search history.

(56) References Cited

U.S. PATENT DOCUMENTS

| | | | |
|---|---|---|---|
| 2,082,275 | A | 6/1937 | Daimler et al. |
| 2,255,082 | A | 9/1941 | Platz et al. |
| 2,438,091 | A | 3/1948 | Lynch |
| 2,528,378 | A | 10/1950 | Mannheimer |
| 2,658,072 | A | 11/1953 | Milton |
| 2,702,279 | A | 2/1955 | Funderburk et al. |
| 3,812,044 | A | 5/1974 | Connor et al. |
| 3,929,678 | A | 12/1975 | Laughlin et al. |
| 4,240,919 | A | 12/1980 | Chapman |
| 4,565,647 | A | 1/1986 | Llenado |
| 4,704,233 | A | 11/1987 | Hartman et al. |
| 5,776,872 | A | 7/1998 | Giret et al. |
| 5,883,062 | A | 3/1999 | Addison et al. |
| 5,906,973 | A | 5/1999 | Ouzounis et al. |
| 6,369,121 | B1 | 4/2002 | Catalfamo et al. |
| 6,699,963 | B2 | 3/2004 | Noda et al. |
| 7,799,968 | B2 | 9/2010 | Chen et al. |
| 2002/0137647 | A1 | 9/2002 | Hackenthal et al. |
| 2006/0065159 | A1 | 3/2006 | Oyasato et al. |
| 2011/0150788 | A1 | 6/2011 | Gonzales et al. |
| 2011/0150951 | A1 | 6/2011 | Gonzales et al. |
| 2011/0262371 | A1* | 10/2011 | Deleersnyder ..... C11D 3/3726 424/49 |
| 2012/0071383 | A1 | 3/2012 | Perez-Prat Vinuesa et al. |
| 2012/0317735 | A1* | 12/2012 | Gonzales ..... C11D 17/0013 15/104.93 |
| 2012/0317736 | A1 | 12/2012 | Gonzales et al. |
| 2012/0321567 | A1 | 12/2012 | Gonzales et al. |
| 2012/0321568 | A1 | 12/2012 | Gonzales et al. |
| 2012/0322713 | A1 | 12/2012 | Perez-Prat Vinuesa et al. |
| 2013/0067669 | A1 | 3/2013 | Gonzales et al. |
| 2013/0072417 | A1 | 3/2013 | Perez-Prat Vinuesa et al. |
| 2014/0352721 | A1 | 12/2014 | Gonzales et al. |
| 2014/0352722 | A1 | 12/2014 | Gonzales et al. |
| 2014/0357544 | A1 | 12/2014 | Gonzales et al. |

FOREIGN PATENT DOCUMENTS

| | | | |
|---|---|---|---|
| EP | 0 957 156 | A1 | 11/1999 |
| EP | 2 338 966 | A1 | 12/2010 |
| WO | WO 2011/087744 | A2 | 7/2011 |
| WO | WO 2011/133508 | A1 | 10/2011 |
| WO | WO 2012/177617 | A1 | 12/2012 |

OTHER PUBLICATIONS

Non-Final Office Action for U.S. Appl. No. 14/281,997, dated Apr. 13, 2015.
Final Office Action for U.S. Appl. No. 14/281,997, dated Oct. 9, 2015, 10 pages.
PCT Search Report dated Sep. 11, 2004; PCT/US2014/039656; 6 Pages.
U.S. Appl. No. 14/282,196, filed May 20, 2014, Cermenati, et al.

* cited by examiner

*Primary Examiner* — Gregory Webb
(74) *Attorney, Agent, or Firm* — Lauren Christine Gonzalez; John T. Dipre

(57) ABSTRACT

A liquid cleaning and/or cleansing composition comprising abrasive cleaning particles; one or more surfactants selected from the group consisting of anionic, nonionic, cationic, amphoteric and mixtures thereof; and a first acidic component wherein said acidic component consists of one or more chelating acids; wherein at least one nonionic surfactant is comprised in said composition and the total level of nonionic surfactant is less than 2% by weight of the total composition and/or at least one anionic surfactant is comprised in said composition and the total level of anionic surfactant is less than 2% by weight of the total composition.

13 Claims, No Drawings

LIQUID CLEANING COMPOSITION WITH ABRASIVES

TECHNICAL FIELD

The present invention relates to liquid compositions for cleaning and/or cleansing a variety of surfaces, including hard surfaces in and around the house, dish surfaces, etc. More specifically, the present invention relates to liquid scouring composition comprising suitable particles for cleaning and/or cleansing. In a highly preferred embodiment, the compositions of the present invention relate to hard surface cleaning compositions.

BACKGROUND OF THE INVENTION

Scouring compositions such as particulate compositions or liquid (incl. gel, paste-type) compositions containing abrasive components are well known in the art. Such compositions are used for cleaning and/or cleansing a variety of surfaces; especially those surfaces that tend to become soiled with difficult to remove stains and soils.

Amongst the currently known scouring compositions, the most popular ones are based on abrasive particles with shapes varying from spherical to irregular. The most common abrasive particles are either inorganic like carbonate salt, clay, silica, silicate, shale ash, perlite and quartz sand or organic polymeric beads like polypropylene, PVC, melamine, urea, polyacrylate, polyurethane and derivatives, and come in the form of liquid composition having a creamy consistency with the abrasive particles suspended therein.

Known abrasive compositions provide improved cleaning versus nil particle compositions and developments have been made on improving surface safety without significantly affecting the cleaning performance.

However, there still remains a need for leveraging synergies between abrasive particles and the formulation in order to maximize the cleaning performance.

It is thus an objective of the present invention to provide a liquid cleaning and/or cleansing composition suitable to clean/cleanse a variety of surfaces, wherein the composition provides good cleaning/cleansing performance at a minimum cost.

It has been found that the above objective can be met by the composition according to the present invention.

SUMMARY OF THE INVENTION

In a first aspect, the present invention relates to a liquid cleaning and/or cleansing composition comprising abrasive cleaning particles; one or more surfactants selected from the group consisting of anionic, nonionic, cationic, amphoteric and mixtures thereof; and a first acidic component wherein said acidic component consists of one or more chelating acids; wherein at least one nonionic surfactant is comprised in said composition and the total level of nonionic surfactant is less than 2% by weight of the total composition and/or at least one anionic surfactant is comprised in said composition and the total level of anionic surfactant is less than 2% by weight of the total composition.

The present invention further encompasses a process of cleaning and/or cleansing a surface with a liquid, cleaning and/or cleansing composition comprising abrasive cleaning particles, wherein said surface is contacted with said composition, preferably wherein said composition is applied onto said surface.

DETAILED DESCRIPTION OF THE INVENTION

The Liquid Cleaning/Cleansing Composition

The compositions according to the present invention are designed as cleaners/cleansers for a variety of inanimate and animate surfaces. In an embodiment, the compositions herein are suitable for cleaning/cleansing surfaces selected from the group consisting of inanimate surfaces, animate surfaces.

In a preferred embodiment, the compositions herein are suitable for cleaning/cleansing inanimate surfaces selected from the group consisting of household hard surfaces; dish surfaces; surfaces like leather or synthetic leather; and automotive vehicles surfaces.

In a highly preferred embodiment, the compositions herein are suitable to clean household hard surfaces.

By "household hard surface", it is meant herein any kind of surface typically found in and around houses like kitchens, bathrooms, e.g., floors, walls, tiles, windows, cupboards, sinks, showers, shower plastified curtains, wash basins, WCs, fixtures and fittings and the like made of different materials like ceramic, vinyl, no-wax vinyl, linoleum, melamine, glass, Inox®, Formica®, any plastics, plastified wood, metal or any painted or varnished or sealed surface and the like. Household hard surfaces also include household appliances including, but not limited to refrigerators, freezers, washing machines, automatic dryers, ovens, microwave ovens, dishwashers and so on. Such hard surfaces may be found both in private households as well as in commercial, institutional and industrial environments.

By "abrasive foam particles" as used herein, it is meant abrasive cleaning or scouring particles derived from fragmenting a foam structure to provide a non-spherical and highly shaped profile.

By "biodegradable" it is meant herein chemical dissolution, disintegration or digestion of biodegradable abrasive particles in a compost media at a rate of above 50% according to ASTM6400 test method. ASTM6400 test method refers to compostability of the material, but herein compositability is referred to as biodegradability. The ultimate biodegradability of biodegradable abrasive particles under controlled composting conditions is determined in this test method.

By "dish surfaces" it is meant herein any kind of surfaces found in dish cleaning, such as dishes, cutlery, cutting boards, pans, and the like. Such dish surfaces may be found both in private households as well as in commercial, institutional and industrial environments.

By "acidic component" it is meant herein the listed components in a solution pH of from 0 to 14 (including when partially or totally neutralised).

By "chelating acid" it is meant herein organic and/or inorganic, preferably organic, acids in their salt form having naturally occurring chelating properties.

In an another preferred embodiment, the compositions herein are suitable for cleaning/cleansing animate surfaces selected from the group consisting of human skin; animal skin; human hair; animal hair; and teeth.

The compositions according to the present invention are liquid compositions as opposed to a solid or a gas. Liquid compositions include compositions having a water-like viscosity as well as thickened compositions, such as gels and pastes.

In a preferred embodiment herein, the liquid compositions herein are aqueous compositions. Therefore, they may comprise from 65% to 99.5% by weight of the total composition of water, preferably from 75% to 98% and more preferably from 80% to 95%.

In another preferred embodiment herein, the liquid compositions herein are mostly non-aqueous compositions although they may comprise from 0% to 10% by weight of the total composition of water, preferably from 0% to 5%, more preferably from 0% to 1% and most preferably 0% by weight of the total composition of water.

In a preferred embodiment, the pH of the composition is from greater than 0 to less than 14, preferably from 2 to 12, more preferably from 2 to 12 but not including between 6 and 8, even more preferably from 2 to 6 or from 8 to 12, most preferably from 2 to 4 or from 8 to 12, measured at 20° C. Most preferred are alkaline compositions having a pH of from 8 to 12, measured at 20° C.

In an embodiment herein, the compositions herein are alkaline compositions, and thus have a pH, as is measured at 20° C., of 8 to 12, more preferably 8.5 to 11.5, even more preferably 9 to 11.5.

In other preferred embodiment compositions have pH of from 2 to 6, preferably 2 to 5 more preferably 2 to 4 and alternatively have pH preferably below pH 9.

Accordingly, the compositions herein may comprise suitable bases and acids to adjust the pH.

A suitable base to be used herein is an organic and/or inorganic base. Suitable bases for use herein are the caustic alkalis, such as sodium hydroxide, potassium hydroxide and/or lithium hydroxide, and/or the alkali metal oxides such, as sodium and/or potassium oxide or mixtures thereof. A preferred base is a caustic alkali, more preferably sodium hydroxide and/or potassium hydroxide.

Other suitable bases include ammonia, ammonium carbonate, all available carbonate salts such as $K_2CO_3$, $Na_2CO_3$, $Ca_2CO_3$, $Mg_2CO_3$, etc., alkanolamines (as e.g. monoethanolamine), urea and urea derivatives, polyamine, etc.

Typical levels of such bases, when present, are of from 0.01% to 5.0% by weight of the total composition, preferably from 0.05% to 3.0% and more preferably from 0.1% to 0.6%.

The compositions herein comprise a first acidic component wherein said first acidic component consists of one or more chelating acids, preferably selected from the group consisting of citric acid, one or more salts of citric acid, citrate, one or more salts of citrate, phosphoric acid, one or more salts of phosphoric acid, tartaric acid, one or more salts of tartaric acid, oxalic acid, one or more salts of oxalic acid, maleic acid, one or more salts of maleic acid, glycolic acid, one or more salts of glycolic acid, succinic acid, one or more salts of succinic acid, glutaric acid, one or more salts of glutaric acid, adipic acid, one or more salts of adipic acid, and mixtures thereof, more preferably selected from the group consisting of citric acid, one or more salts of citric acid, citrate, one or more salts of citrate, phosphoric acid, salts of phosphoric acid, and mixtures thereof. The level of said first acidic component is preferably from greater than 0% to less than 0.5%, preferably from 0.1% to 0.48%, more preferably from 0.2% to 0.47%, even more preferably from 0.3% to 0.46%, by weight of the composition. It has surprisingly been found that small levels of such first acidic component provide improved cleaning of a particle containing composition. Once the level of such component is increased to 0.5% by weight or higher, the cleaning is no longer improved and thus material is added with no further benefits on cleaning.

The compositions herein may comprise a second acidic component wherein said second acidic component consists of one or more non-chelating acids, preferably selected from the group consisting of formic acid, one or more salts of formic acid, lactic acid, one or more salts of lactic acid, hydrochloric acid, one or more salts of hydrochloric acid, sulphuric acid, one or more salts of sulphuric acids, and mixtures thereof. The combination of first and second acidic components provides added stability as well as added benefits towards limescale removal from hard surfaces.

A typical level of such further acids, when present, is of from 0.01% to 5.0% by weight of the total composition, preferably from 0.04% to 3.0% and more preferably from 0.05% to 1.5%.

In a preferred embodiment according to the present invention the compositions herein are thickened compositions. Preferably, the liquid compositions herein have a viscosity of up to 7500 cps at 20 $s^{-1}$, more preferably from 5000 cps to 50 cps, yet more preferably from 2000 cps to 50 cps and most preferably from 1500 cps to 300 cps at 20 $s^{-1}$ and 20° C. when measured with a Rheometer, model AR 1000 (Supplied by TA Instruments) with a 4 cm conic spindle in stainless steel, 2° angle (linear increment from 0.1 to 100 $sec^{-1}$ in max. 8 minutes).

In another embodiment, the compositions herein have a water-like viscosity. By "water-like viscosity" it is meant herein a viscosity that is close to that of water. Preferably the liquid compositions herein have a viscosity of up to 50 cps at 60 rpm, more preferably from 0 cps to 30 cps, yet more preferably from 0 cps to 20 cps and most preferably from 0 cps to 10 cps at 60 rpm and 20° C. when measured with a Brookfield digital viscometer model DV II, with spindle 2.

The compositions herein comprise one or more surfactants selected from the group consisting of anionic, nonionic, cationic, amphoteric and mixtures thereof; and wherein at least one nonionic surfactant is comprised in the composition and the total level of nonionic surfactant is less than 2%, preferably from 0.1% to 1.95%, more preferably from 0.2% to 1.8%, most preferably from 0.5% to 1.75%, by weight of the total composition and/or at least one anionic surfactant is comprised in the composition and the total level of anionic surfactant is less than 2%, preferably from 0.1% to 1.95%, more preferably from 0.2% to 1.8%, most preferably from 0.5% to 1.75%, by weight of the total composition. It has been surprisingly found that such levels of surfactant synergistically work with the abrasive particles to provide better cleaning, but once the level exceeds the above ranges, no substantial improvement is observed versus the cost associated with adding such excess material.

Non-limiting examples of suitable non-ionic surfactants include alcohol alkoxylates, alkyl polysaccharides, amine oxides, block copolymers of ethylene oxide and propylene oxide, fluoro surfactants and silicon based surfactants.

A preferred class of non-ionic surfactants suitable for the present invention is alkyl ethoxylates. The alkyl ethoxylates of the present invention are either linear or branched, and contain from 8 carbon atoms to 16 carbon atoms in the hydrophobic tail, and from 3 ethylene oxide units to 25 ethylene oxide units in the hydrophilic head group. Examples of alkyl ethoxylates include Neodol 91-6®, Neodol 91-8® supplied by the Shell Corporation (P.O. Box 2463, 1 Shell Plaza, Houston, Tex.), and Alfonic 810-60® supplied by Condea Corporation, (900 Threadneedle P.O. Box 19029, Houston, Tex.). More preferred alkyl ethoxylates comprise from 9 to 12 carbon atoms in the hydrophobic tail, and from 4 to 9 oxide units in the hydrophilic head group. A preferred alkyl ethoxylate is $C_{9-11}$ $EO_5$, available from the Shell Chemical Company under the tradename Neodol 91-5®. A most preferred alkyl ethoxylate is $C_{9-11}$ $EO_8$, available from the Shell Chemical Company under the tradename Neodol 91-8®. Other preferred nonionic surfactants are $C_{10}$ $EO_8$, available from Kolbe under the tradename Greenbentine DE80, or $C_{10}$ $EO_8$ available from Sasol under the tradename Maripal 10/8. Non-ionic ethoxylates can also be derived from branched alcohols. For example, alcohols can be made from branched olefin feedstocks such as propylene or butylene. In a preferred embodiment, the branched alcohol is either a 2-propyl-1-heptyl alcohol or 2-butyl-1-octyl alcohol. A desirable branched alcohol ethoxylate is 2-propyl-1-heptyl EO7/AO7, manufactured and sold by BASF Corporation under the tradename Lutensol XP 79/XL 79®.

Another class of non-ionic surfactant suitable for the present invention is alkyl polysaccharides. Such surfactants are disclosed in U.S. Pat. Nos. 4,565,647, 5,776,872, 5,883,062, and 5,906,973. Among alkyl polysaccharides, alkyl polyglycosides comprising five and/or six carbon sugar rings are preferred, those comprising six carbon sugar rings are more preferred, and those wherein the six carbon sugar ring is derived from glucose, i.e., alkyl polyglucosides ("APG"), are most preferred. The alkyl substituent in the APG chain length is preferably a saturated or unsaturated alkyl moiety containing from 8 to 16 carbon atoms, with an average chain length of 10 carbon atoms. $C_8$-$C_{16}$ alkyl polyglucosides are commercially available from several suppliers (e.g., Simusol® surfactants from Seppic Corporation, 75 Quai d'Orsay, 75321 Paris, Cedex 7, France, and Glucopon 220®, Glucopon 225®, Glucopon 425®, Plantaren 2000 N®, and Plantaren 2000 N UP®, from Cognis Corporation, Postfach 13 01 64, D 40551, Dusseldorf, Germany).

Another class of non-ionic surfactant suitable for the present invention is amine oxide. Amine oxides, particularly those comprising from 10 carbon atoms to 16 carbon atoms in the hydrophobic tail, are beneficial because of their strong cleaning profile and effectiveness even at levels below 0.10%. Additionally $C_{10-16}$ amine oxides, especially $C_{12}$-$C_{14}$ amine oxides are excellent solubilizers of perfume. Alternative non-ionic detergent surfactants for use herein are alkoxylated alcohols generally comprising from 8 to 16 carbon atoms in the hydrophobic alkyl chain of the alcohol. Typical alkoxylation groups are propoxy groups or ethoxy groups in combination with propoxy groups, yielding alkyl ethoxy propoxylates. Such compounds are commercially available under the tradename Antarox® available from Rhodia (40 Rue de la Haie-Coq F-93306, Aubervilliers Cédex, France) and under the tradename Nonidet® available from Shell Chemical.

The condensation products of ethylene oxide with a hydrophobic base formed by the condensation of propylene oxide with propylene glycol are also suitable for use herein. The hydrophobic portion of these compounds will preferably have a molecular weight of from 1500 to 1800 and will exhibit water insolubility. The addition of polyoxyethylene moieties to this hydrophobic portion tends to increase the water solubility of the molecule as a whole, and the liquid character of the product is retained up to the point where the polyoxyethylene content is about 50% of the total weight of the condensation product, which corresponds to condensation with up to 40 moles of ethylene oxide. Examples of compounds of this type include certain of the commercially available Pluronic® surfactants, marketed by BASF. Chemically, such surfactants have the structure $(EO)_x(PO)_y(EO)_z$ or $(PO)_x(EO)_y(PO)_z$ wherein x, y, and z are from 1 to 100, preferably 3 to 50. Pluronic® surfactants known to be good wetting surfactants are more preferred. A description of the Pluronic® surfactants, and properties thereof, including wetting properties, can be found in the brochure entitled "BASF Performance Chemicals Plutonic® & Tetronic® Surfactants", available from BASF.

Other suitable though not preferred non-ionic surfactants include the polyethylene oxide condensates of alkyl phenols, e.g., the condensation products of alkyl phenols having an alkyl group containing from 6 to 12 carbon atoms in either a straight chain or branched chain configuration, with ethylene oxide, the said ethylene oxide being present in amounts equal to 5 to 25 moles of ethylene oxide per mole of alkyl phenol. The alkyl substituent in such compounds can be derived from oligomerized propylene, diisobutylene, or from other sources of iso-octane n-octane, iso-nonane or n-nonane. Other non-ionic surfactants that can be used include those derived from natural sources such as sugars and include $C_8$-$C_{16}$ N-alkyl glucose amide surfactants.

Suitable anionic surfactants for use herein are selected from the group consisting of alkyl sulphonates, alkyl aryl sulphonates, alkyl sulphates, alkyl alkoxylated sulphates, $C_6$-$C_{20}$ alkyl alkoxylated linear or branched diphenyl oxide disulphonates, or mixtures thereof.

Suitable alkyl sulphonates for use herein include water-soluble salts or acids of the formula $RSO_3M$ wherein R is a $C_6$-$C_{20}$ linear or branched, saturated or unsaturated alkyl group, preferably a $C_8$-$C_{18}$ alkyl group and more preferably a $C_{10}$-$C_{16}$ alkyl group, and M is H or a cation, e.g., an alkali metal cation (e.g., sodium, potassium, lithium), or ammonium or substituted ammonium (e.g., methyl-, dimethyl-, and trimethyl ammonium cations and quaternary ammonium cations, such as tetramethyl-ammonium and dimethyl piperidinium cations and quaternary ammonium cations derived from alkylamines such as ethylamine, diethylamine, triethylamine, and mixtures thereof, and the like).

Suitable alkyl aryl sulphonates for use herein include water-soluble salts or acids of the formula $RSO_3M$ wherein R is an aryl, preferably a benzyl, substituted by a $C_6$-$C_{20}$ linear or branched saturated or unsaturated alkyl group, preferably a $C_8$-$C_{18}$ alkyl group and more preferably a $C_{10}$-$C_{16}$ alkyl group, and M is H or a cation, e.g., an alkali metal cation (e.g., sodium, potassium, lithium, calcium, magnesium and the like) or ammonium or substituted ammonium (e.g., methyl-, dimethyl-, and trimethyl ammonium cations and quaternary ammonium cations, such as tetramethyl-ammonium and dimethyl piperidinium cations and quaternary ammonium cations derived from alkylamines such as ethylamine, diethylamine, triethylamine, and mixtures thereof, and the like).

An example of a $C_{14}$-$C_{16}$ alkyl sulphonate is Hostapur® SAS available from Hoechst. An example of commercially available alkyl aryl sulphonate is Lauryl aryl sulphonate from Su.Ma. Particularly preferred alkyl aryl sulphonates are alkyl benzene sulphonates commercially available under trade name Nansa® available from Albright&Wilson.

Suitable alkyl sulphate surfactants for use herein are according to the formula $R_1SO_4M$ wherein $R_1$ represents a hydrocarbon group selected from the group consisting of straight or branched alkyl radicals containing from 6 to 20 carbon atoms and alkyl phenyl radicals containing from 6 to 18 carbon atoms in the alkyl group. M is H or a cation, e.g., an alkali metal cation (e.g., sodium, potassium, lithium, calcium, magnesium and the like) or ammonium or substituted ammonium (e.g., methyl-, dimethyl-, and trimethyl ammonium cations and quaternary ammonium cations, such as tetramethyl-ammonium and dimethyl piperidinium cations and quaternary ammonium cations derived from alkylamines such as ethylamine, diethylamine, triethylamine, and mixtures thereof, and the like). Particularly preferred branched alkyl sulphates to be used herein are those containing from 10 to 14 total carbon atoms like Isalchem 123 AS®. Isalchem 123 AS® commercially available from Enichem is a $C_{12-13}$ surfactant which is 94% branched. This material can be described as $CH_3$—$(CH_2)_m$—CH $(CH_2OSO_3Na)$—$(CH_2)_n$—$CH_3$ where n+m=8-9. Also preferred alkyl sulphates are the alkyl sulphates where the alkyl chain comprises a total of 12 carbon atoms, i.e., sodium 2-butyl octyl sulphate. Such alkyl sulphate is commercially available from Condea under the trade name Isofol® 12S. Particularly suitable liner alkyl sulphonates include $C_{12}$-$C_{16}$ paraffin sulphonate like Hostapur® SAS commercially available from Hoechst.

Suitable alkyl alkoxylated sulphate surfactants for use herein are according to the formula $RO(A)_mSO_3M$ wherein R is an unsubstituted $C_6$-$C_{20}$ alkyl or hydroxyalkyl group having a $C_6$-$C_{20}$ alkyl component, preferably a $C_{12}$-$C_{20}$ alkyl or hydroxyalkyl, more preferably $C_{12}$-$C_{18}$ alkyl or hydroxyalkyl, A is an ethoxy or propoxy unit, m is greater than zero, typically between 0.5 and 6, more preferably between 0.5 and 3, and M is H or a cation which can be, for example, a metal cation (e.g., sodium, potassium, lithium, calcium, magnesium, etc.), ammonium or substituted-ammonium cation. Alkyl ethoxylated sulfates as well as alkyl propoxylated sulfates are contemplated herein. Specific examples of substituted ammonium cations include methyl-, dimethyl-, trimethyl-ammonium and quaternary ammonium cations, such as tetramethyl-ammonium, dimethyl piperidinium and cations derived from alkanolamines such as ethylamine, diethylamine, triethylamine, mixtures thereof, and the like. Exemplary surfactants are $C_{12}$-$C_{18}$ alkyl polyethoxylate (1.0) sulfate ($C_{12}$-$C_{18}$E(1.0)SM), $C_{12}$-$C_{18}$ alkyl polyethoxylate (2.25) sulfate ($C_{12}$-$C_{18}$E(2.25)SM), $C_{12}$-$C_{18}$ alkyl polyethoxylate (3.0) sulfate ($C_{12}$-$C_{18}$E(3.0)SM), $C_{12}$-$C_{18}$ alkyl polyethoxylate (4.0) sulfate ($C_{12}$-$C_{18}$E, (4.0)SM), wherein M is conveniently selected from sodium and potassium.

Suitable $C_6$-$C_{20}$ alkyl alkoxylated linear or branched diphenyl oxide disulphonate surfactants for use herein are according to the following formula:

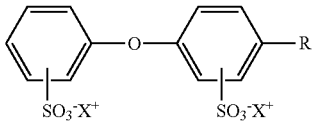

wherein R is a $C_6$-$C_{20}$ linear or branched, saturated or unsaturated alkyl group, preferably a $C_{12}$-$C_{18}$ alkyl group and more preferably a $C_{14}$-$C_{16}$ alkyl group, and X+ is H or a cation, e.g., an alkali metal cation (e.g., sodium, potassium, lithium, calcium, magnesium and the like). Particularly suitable $C_6$-$C_{20}$ alkyl alkoxylated linear or branched diphenyl oxide disulphonate surfactants to be used herein are the $C_{12}$ branched di phenyl oxide disulphonic acid and $C_{16}$ linear di phenyl oxide disulphonate sodium salt respectively commercially available by DOW under the trade name Dowfax 2A1® and Dowfax 8390®.

Other anionic surfactants useful herein include salts (including, for example, sodium, potassium, ammonium, and substituted ammonium salts such as mono-, di- and triethanolamine salts) of soap, $C_8$-$C_{24}$ olefinsulfonates, sulphonated polycarboxylic acids prepared by sulphonation of the pyrolyzed product of alkaline earth metal citrates, e.g., as described in British patent specification No. 1,082,179, $C_8$-$C_{24}$ alkylpolyglycolethersulfates (containing up to 10 moles of ethylene oxide); alkyl ester sulfonates such as $C_{14}$-$C_{16}$ methyl ester sulfonates; acyl glycerol sulfonates, fatty oleyl glycerol sulfates, alkyl phenol ethylene oxide ether sulfates, alkyl phosphates, isethionates such as the acyl isethionates, N-acyl taurates, alkyl succinamates and sulfosuccinates, monoesters of sulfosuccinate (especially saturated and unsaturated $C_{12}$-$C_{18}$ monoesters) diesters of sulfosuccinate (especially saturated and unsaturated $C_6$-$C_{14}$ diesters), acyl sarcosinates, sulfates of alkylpolysaccharides such as the sulfates of alkylpolyglucoside (the nonionic nonsulfated compounds being described below), alkyl polyethoxy carboxylates such as those of the formula $RO(CH_2CH_2O)_kCH_2COO^-M^+$ wherein R is a $C_8$-$C_{22}$ alkyl, k is an integer from 0 to 10, and M is a soluble salt-forming cation. Resin acids and hydrogenated resin acids are also suitable, such as rosin, hydrogenated rosin, and resin acids and hydrogenated resin acids present in or derived from tall oil. Further examples are given in "Surface Active Agents and Detergents" (Vol. I and II by Schwartz, Perry and Berch). A variety of such surfactants are also generally disclosed in U.S. Pat. No. 3,929,678, issued Dec. 30, 1975 to Laughlin, et al. at Column 23, line 58 through Column 29, line 23.

Zwitterionic surfactants represent another class of preferred surfactants within the context of the present invention.

Zwitterionic surfactants contain both cationic and anionic groups on the same molecule over a wide pH range. The typical cationic group is a quaternary ammonium group, although other positively charged groups like sulfonium and phosphonium groups can also be used. The typical anionic groups are carboxylates and sulfonates, preferably sulfonates, although other groups like sulfates, phosphates and the like, can be used. Some common examples of these detergents are described in the patent literature: U.S. Pat. Nos. 2,082,275, 2,702,279 and 2,255,082.

A specific example of a zwitterionic surfactant is 3-(N-dodecyl-N,N-dimethyl)-2-hydroxypropane-1-sulfonate (Lauryl hydroxyl sultaine) available from the McIntyre Company (24601 Governors Highway, University Park, Ill. 60466, USA) under the tradename Mackam LHS®. Another specific zwitterionic surfactant is $C_{12-14}$ acylamidopropylene (hydroxypropylene) sulfobetaine that is available from McIntyre under the tradename Mackam 50-SB®. Other very useful zwitterionic surfactants include hydrocarbyl, e.g., fatty alkylene betaines. A highly preferred zwitterionic surfactant is Empigen BB®, a coco dimethyl betaine produced by Albright & Wilson. Another equally preferred zwitterionic surfactant is Mackam 35HP®, a coco amido propyl betaine produced by McIntyre.

Another class of surfactants comprises the group consisting of amphoteric surfactants. One suitable amphoteric surfactant in compositions of the present invention is a $C_8$-$C_{16}$ amido alkylene glycinate surfactant ('ampho glycinate'). Another suitable amphoteric surfactant is a $C_8$-$C_{16}$ amido alkylene propionate surfactant ('ampho propionate'). Other suitable, amphoteric surfactants are represented by surfactants such as dodecylbeta-alanine, N-alkyltaurines such as the one prepared by reacting dodecylamine with sodium isethionate according to the teaching of U.S. Pat. No. 2,658,072, N-higher alkylaspartic acids such as those produced according to the teaching of U.S. Pat. No. 2,438,091, and the products sold under the trade name "Miranol®", and described in U.S. Pat. No. 2,528,378.

Abrasive Cleaning Particles

In a preferred embodiment, the abrasive cleaning particles have a mean ECD from 10 μm to 1000 μm, preferably from 50 μm to 500 μm, more preferably from 100 μm to 350 μm and most preferably from 150 to 250 μm.

Indeed, the Applicant has found that the abrasive particle size may achieve efficient cleaning performance, whereas excessively abrasive population with small particle sizes e.g.: typically below 10 micrometers feature polishing action vs. cleaning despite featuring a high number of particles per particle load in cleaner inherent to the small particle size. On the other hand, abrasive population with excessively high particle size, e.g.: typically above 1000 micrometers, delivers not optimal cleaning efficiency since the number of particles per particle load in cleaner decreases significantly inherently to the large particle size. Additionally, excessively small particle size are not desirable in cleaner/for cleaning task since in practice, small and numerous particles are often hard to remove from the various surface topologies which requires excessive effort to remove from the user unless leaving the surface with visible particles residue. On the other hand, excessively large particle are too easily detected visually or provide bad tactile experience while handling or using the cleaner. Therefore, the applicants define herein an optimal particle size range which delivers both optimal cleaning performance and usage experience.

The abrasive particles have size defined by their area-equivalent diameter (ISO 9276-6:2008(E) section 7) also called Equivalent Circle Diameter ECD (ASTM F1877-05 Section 11.3.2). Mean ECD of particle population is calculated as the average of respective ECD of each particles of a particle population of at least 10 000 particles, preferably above 50 000 particles, more preferably above 100 000 particles after excluding from the measurement and calculation the data of particles having area-equivalent diameter (ECD) of below 10 micrometers. Mean data are extracted from volume-based vs. number-based measurements.

In one preferred example, the size of the abrasive cleaning particles used in the present invention is modified during usage especially undergoing significant size reduction. Hence the particle remain visible or tactile detectable in liquid composition and at the start of the usage process to provide effective cleaning. As the cleaning process progresses, the abrasive particles disperse or break into smaller particles and become invisible to an eye or tactile undetectable.

It has surprisingly been found that the abrasive cleaning particles of the present invention show a good cleaning performance even at relatively low levels, such as preferably from 0.1% to less than 10% by weight of the total composition of said abrasive cleaning particles, preferably from 0.1% to 8%, more preferably from 0.5% to 5%, even more preferably from 0.5% to less than 5%, most preferably from 0.5% to less than 3%.

The particles used in the present invention can be white, transparent or colored by use of suitable dyes and/or pigments. Additionally suitable color stabilizing agents can be used to stabilize desired color. The abrasive particles are preferable color stable particles.

In one preferred example, the abrasive cleaning particles used in the present invention remain visible when liquid composition is stored into a bottle while during the effective cleaning process abrasive particles disperse or break into smaller particles and become invisible to an eye.

A particularly suitable mean to achieve low packing density abrasive particles is to expand the abrasive material with gas e.g.: via a foaming process. In a preferred embodiment the abrasive cleaning particles have been reduced from a precursor foamed biodegradable thermoplastic material preferably via grinding or milling.

Preferably the abrasive particles are made from biodegradable thermoplastic materials preferably selected the group consisting of biodegradable polyesters preferably selected from the group consisting of polyhydroxy-alkanoates, poly(lactic acid), poly(glycolic), polycaprolactone, polyesteramide, aliphatic copolyesters, aromatic copolyesters, and mixtures thereof; thermoplastic starch; cellulose esters particularly cellulose acetate and/or nitrocellulose and their derivatives; and mixtures thereof; preferably a blend of a biodegradable polyester and a thermoplastic starch.

In a most preferred embodiment, the biodegradable thermoplastic material is selected from biodegradable petroleum-based polyesters and mixtures thereof, preferably the biodegradable petroleum-based polyesters are selected from the group consisting of polycaprolactone, polyesteramide, aliphatic copolyesters, aromatic copolyesters, and mixtures thereof; thermoplastic starch; cellulose esters particularly cellulose acetate and/or nitrocellulose and their derivatives; and mixtures thereof; preferably a blend of biodegradable petroleum-based polyester and a thermoplastic starch, preferably a blend of polycaprolactone and a thermoplastic starch. Such have been found to provide excellent foamability as well as biodegradability. The resulting particles thus providing the desirable biodegradability rate as well as structural strength provided within the above cited ranges of packing density.

The abrasive cleaning foam particles used in the present invention have a biodegradable rate of greater than 50%, preferably greater than 65%, more preferably greater than 75%, even more preferably greater than 80%, most preferably greater than 90%, according to ASTM6400 test method. Biodegradable materials discussed herein are materials which biodegrade according to protocol and requirements described in ASTM6400 test method.

In a preferred embodiment, low packing density material is produced from foamed or expanded biodegradable thermoplastic material used with or without filler. The particles of the present invention having packing density within desired target range are reduced in particles with typical grinding or milling processes from the foamed or expanded material. Other suitable means for reducing the foamed or expanded material into abrasive particles include the use of eroding tools, such as a high speed eroding wheel with dust collector wherein the surface of the wheel is engraved with a pattern or is coated with abrasive sandpaper or the like to form the abrasive cleaning particles herein.

In an embodiment the abrasive particles are obtained from a foam by reducing (preferably by grinding or milling) the foam into abrasive particles. More preferably the abrasive particles are obtained from foamed biodegradable thermoplastic material selected from the group consisting of biodegradable polyesters preferably selected from the group consisting of polyhydroxy-alkanoates, poly(lactic acid), poly(glycolic), polycaprolactone, polyesteramide, aliphatic copolyesters, aromatic copolyesters, and mixtures thereof; thermoplastic starch; cellulose esters particularly cellulose acetate and/or nitrocellulose and their derivatives; and mixtures thereof; preferably a blend of a biodegradable polyester and a thermoplastic starch.

In a preferred embodiment the abrasive particles are obtained from a foam by reducing (preferably by grinding or milling) the foam into abrasive particles. More preferably the abrasive particles are obtained from foamed biodegradable thermoplastic material selected from biodegradable petroleum-based polyesters and mixtures thereof, preferably the biodegradable petroleum-based polyesters are selected from the group consisting of polycaprolactone, polyesteramide, aliphatic copolyesters, aromatic copolyesters, and mixtures thereof; thermoplastic starch; cellulose esters particularly cellulose acetate and/or nitrocellulose and their derivatives; and mixtures thereof; preferably a blend of biodegradable petroleum-based polyester and a thermoplastic starch, preferably a blend of polycaprolactone and a thermoplastic starch.

Foaming and/or expanding processes of the raw material into a foam structure are typically achieved via gas expansion process. Gas expansion process can happen either by injecting gas or solvent within the abrasive precursor or allowing expansion by pressure drop and/or increase of temperature, e.g.: extrusion foaming process.

Foaming processes and foam structures are also typically achieved via emulsion foaming of monomers followed by a hardening step via chemical, heat or radiative e.g.: UV curing and if necessary followed by a drying step of the solidified foam. Examples of materials, foaming and curing process are extensively described in literature (e.g.: refer to book "Emulsion Polymer Technology" from Robert D. Athey). A preferred route for production of the foam is to form a water/oil high internal phase emulsion of water in the monomer mixture and polymerize in-situ, as described in U.S. Pat. No. 6,369,121 to Catalfamo et al.

Foaming processes and foam structures are typically achieved by mechanical agitation e.g.; battering of a viscous mix e.g.: typically including protein with emulsifying and possibly stabilizing features followed by a step of curing/hardening and if necessary drying of the solidified foam. Non-exhaustive examples of proteins are white egg or pure albumen, gelatin, saponin, gluten, soybean protein, globulin, prolamine, glutelin, histone, protamine and mixtures thereof. The protein is often agitated in presence of water, emulsifying agent, stabilizers e.g.: alginic acid, and much desirably a significant amount of polymerizable monomer and/crosslinker to achieve sufficient hardness of the foam. For further reference refer to book "Functionality of Proteins in Food" from Joseph F. Zayas, "Protein Functionality in Food Systems" from Hettiarachchy, Article in Journal of Cereal science 47 (2008) 233-238 from E. Zukowska et Al; or US2006/0065159.

In a highly preferred embodiment herein, in order to achieve desired packing density of the abrasive cleaning particles, the abrasive cleaning particles are obtained from foamed biodegradable thermoplastic material, which is reduced into the abrasive particles preferably by grinding or milling as described above.

The applicant has found that low packing density particles can be achieved from foams with controlled foam density, foam cell size and struts aspect ratio. Low packing density particles can be produced by foam having density above 100 $kg/m^3$ and even up to 500 $kg/m^3$. However the applicant has found that lower packing density particles can be produced from foam having density below 100 $kg/m^3$, more preferably from 50 $kg/m^3$ to 100 $kg/m^3$ and most preferably from 5 $kg/m^3$ to 50 $kg/m^3$. (ASTM D3574 can be used as protocol to evaluate foam density).

Similarly, low packing density particles can be produced from foams with cell size ranging from 20 micrometers till 2000 micrometers. However the applicant found that lower packing density can be achieved with the foam featuring cell size from 100 micrometers to 1000 micrometers, more preferably from 200 micrometers to 500 micrometers and most preferably from 300 micrometers to 450 micrometers (ASTM D3576 can be used as protocol to evaluate cell size). By the term cell size is meant by the diameter of an imaginary sphere inscribed in the Pentagonal dodecahedron structure of the foam and can be measured with use of the Visiocell software.

The applicant also found that low packing density particles can be achieved from foams made of struts with high aspect ratio. By struts, meant to define the elongated material that are interconnecting to form the cellular structure of the foam, e.g.: best described as a pentagonal dodecahedron structure for foams with density typically between 5 and 50 $kg/m^3$ targeted herein. The struts length (L) is typically counted as the distance between the geometrical centers of 2 interconnecting knots. The struts thickness (T) is typically the projected strut thickness at the middle of the strut length. The Applicant has understood that particles that are derived from foam presenting struts with excessively small L/T ratio, will present sub-optimal shape for cleaning since likely to produce rounder particle with high rolling. On the contrary, the particles that are derived from foam presenting struts with excessively high L/T ratio will also present sub-optimal shape for cleaning since likely to produce excessive amount of rod-like particles featuring low soil removal. Incidentally, the Applicant have surprisingly found that significantly low packing density particles can be achieved with struts L/T ratio ranging from 1.5 to 10, preferably from 2.0 to 8.0 and more preferably from 3.0 to 6.0 and most preferred from 3.5 to 4.5 as defined by Visiocell software.

Optional Ingredients

The compositions according to the present invention may comprise a variety of optional ingredients depending on the technical benefit aimed for and the surface treated.

Suitable optional ingredients for use herein include chelating agents, surfactants, radical scavengers, perfumes, surface-modifying polymers, solvents, builders, buffers, bactericides, hydrotropes, colorants, stabilizers, bleaches, bleach activators, suds controlling agents like fatty acids, enzymes, soil suspenders, brighteners, anti dusting agents, dispersants, pigments, and dyes.

Suspending Aid

The abrasive cleaning particles present in the composition herein are solid particles in a liquid composition. Said abrasive cleaning particles may be suspended in the liquid composition. However, it is well within the scope of the present invention that such abrasive cleaning particles are not-stably suspended within the composition and either settle or float on top of the composition. In this case, a user may have to temporally suspend the abrasive cleaning particles by agitating (e.g., shaking or stirring) the composition prior to use.

However, it is preferred herein that the abrasive cleaning particles are stably suspended in the liquid compositions herein. Thus the compositions herein comprise a suspending aid that effectively provides a yield keeping the particles in a suspended state.

The suspending aid herein may either be a compound specifically chosen to provide a suspension of the abrasive cleaning particles in the liquid compositions of the present invention, such as a structurant, or a compound that also provides another function, such as a thickener or a surfactant (as described herein elsewhere).

Any suitable organic and inorganic suspending aids typically used as gelling, thickening or suspending agents in cleaning/cleansing compositions and other detergent or cosmetic compositions may be used herein. Indeed, suitable organic suspending aids include polysaccharide polymers.

In addition or as an alternative, polycarboxylate polymer thickeners may be used herein. Also, in addition or as an alternative of the above, layered silicate platelets e.g.: Hectorite, bentonite or montmorillonites can also be used. Suitable commercially available layered silicates are Laponite RD® or Optigel CL® available from Rockwood Additives.

Suitable polycarboxylate polymer thickeners include (preferably lightly) crosslinked polyacrylate. A particularly suitable polycarboxylate polymer thickeners is Carbopol commercially available from Lubrizol under the trade name Carbopol 674®.

Suitable polysaccharide polymers for use herein include substituted cellulose materials like carboxymethylcellulose, ethyl cellulose, hydroxyethyl cellulose, hydroxypropyl cellulose, hydroxymethyl cellulose, succinoglycan and naturally occurring polysaccharide polymers like Xanthan gum, gellan gum, guar gum, locust bean gum, tragacanth gum, succinoglucan gum, or derivatives thereof, or mixtures thereof. Xanthan gum is commercially available from Kelco under the tradename Kelzan T.

Preferably the suspending aid herein is Xanthan gum. In an alternative embodiment, the suspending aid herein is a polycarboxylate polymer thickeners preferably a (preferably lightly) crosslinked polyacrylate. In a highly preferred embodiment herein, the liquid compositions comprise a combination of a polysaccharide polymer or a mixture thereof, preferably Xanthan gum, with a polycarboxylate polymer or a mixture thereof, preferably a crosslinked polyacrylate.

As a preferred example, Xanthan gum is preferably present at levels between 0.1% to 5% by weight of the total composition, more preferably from 0.5% to 2%, even more preferably from 0.8% to 1.2%.

Organic Solvent

As an optional but highly preferred ingredient the composition herein comprises an organic solvents or mixtures thereof.

The compositions herein comprise from 0% to 30% by weight of the total composition of an organic solvent or a mixture thereof, more preferably 1.0% to 20% and most preferably, 2% to 15%.

Suitable solvents can be selected from the group consisting of: aliphatic alcohols, ethers and diethers having from 4 to 14 carbon atoms, preferably from 6 to 12 carbon atoms, and more preferably from 8 to 10 carbon atoms; glycols or alkoxylated glycols; glycol ethers; alkoxylated aromatic alcohols; aromatic alcohols; terpenes; and mixtures thereof. Aliphatic alcohols and glycol ether solvents are most preferred.

Aliphatic alcohols, of the formula R—OH wherein R is a linear or branched, saturated or unsaturated alkyl group of from 1 to 20 carbon atoms, preferably from 2 to 15 and more preferably from 5 to 12, are suitable solvents. Suitable aliphatic alcohols are methanol, ethanol, propanol, isopropanol or mixtures thereof. Among aliphatic alcohols, ethanol and isopropanol are most preferred because of their high vapour pressure and tendency to leave no residue.

Suitable glycols to be used herein are according to the formula HO—$CR_1R_2$—OH wherein R1 and R2 are independently H or a $C_2$-$C_{10}$ saturated or unsaturated aliphatic hydrocarbon chain and/or cyclic. Suitable glycols to be used herein are dodecaneglycol and/or propanediol.

In one preferred embodiment, at least one glycol ether solvent is incorporated in the compositions of the present invention. Particularly preferred glycol ethers have a terminal $C_3$-$C_6$ hydrocarbon attached to from one to three ethylene glycol or propylene glycol moieties to provide the appropriate degree of hydrophobicity and, preferably, surface activity. Examples of commercially available solvents based on ethylene glycol chemistry include mono-ethylene glycol n-hexyl ether (Hexyl Cellosolve®) available from Dow Chemical. Examples of commercially available solvents based on propylene glycol chemistry include the di-, and tri-propylene glycol derivatives of propyl and butyl alcohol, which are available from Arco under the trade names Arcosolv® and Dowanol®.

In the context of the present invention, preferred solvents are selected from the group consisting of mono-propylene glycol mono-propyl ether, di-propylene glycol mono-propyl ether, mono-propylene glycol mono-butyl ether, di-propylene glycol mono-propyl ether, di-propylene glycol mono-butyl ether; tri-propylene glycol mono-butyl ether; ethylene glycol mono-butyl ether; di-ethylene glycol mono-butyl ether, ethylene glycol mono-hexyl ether and di-ethylene glycol mono-hexyl ether, and mixtures thereof. "Butyl" includes normal butyl, isobutyl and tertiary butyl groups. Mono-propylene glycol and mono-propylene glycol mono-butyl ether are the most preferred cleaning solvent and are available under the tradenames Dowanol DPnP® and Dowanol DPnB®. Di-propylene glycol mono-t-butyl ether is commercially available from Arco Chemical under the tradename Arcosolv PTB®.

In a particularly preferred embodiment, the cleaning solvent is purified so as to minimize impurities. Such impurities include aldehydes, dimers, trimers, oligomers and other by-products. These have been found to deleteriously affect product odour, perfume solubility and end result. The inventors have also found that common commercial solvents, which contain low levels of aldehydes, can cause irreversible and irreparable yellowing of certain surfaces. By purifying the cleaning solvents so as to minimize or eliminate such impurities, surface damage is attenuated or eliminated.

Though not preferred, terpenes can be used in the present invention. Suitable terpenes to be used herein monocyclic terpenes, dicyclic terpenes and/or acyclic terpenes. Suitable terpenes are: D-limonene; pinene; pine oil; terpinene; terpene derivatives as menthol, terpineol, geraniol, thymol; and the citronella or citronellol types of ingredients.

Suitable alkoxylated aromatic alcohols to be used herein are according to the formula R-$(A)_n$-OH wherein R is an alkyl substituted or non-alkyl substituted aryl group of from 1 to 20 carbon atoms, preferably from 2 to 15 and more preferably from 2 to 10, wherein A is an alkoxy group preferably butoxy, propoxy and/or ethoxy, and n is an integer of from 1 to 5, preferably 1 to 2. Suitable alkoxylated aromatic alcohols are benzoxyethanol and/or benzoxypropanol.

Suitable aromatic alcohols to be used herein are according to the formula R—OH wherein R is an alkyl substituted or non-alkyl substituted aryl group of from 1 to 20 carbon atoms, preferably from 1 to 15 and more preferably from 1 to 10. For example a suitable aromatic alcohol to be used herein is benzyl alcohol.

Chelating Agents

One class of optional compounds for use herein includes chelating agents or mixtures thereof. Chelating agents can be incorporated in the compositions herein in amounts ranging from 0.0% to 10.0% by weight of the total composition, preferably 0.01% to 5.0%.

Suitable phosphonate chelating agents for use herein may include alkali metal ethane 1-hydroxy diphosphonates (HEDP), alkylene poly (alkylene phosphonate), as well as amino phosphonate compounds, including amino aminotri (methylene phosphonic acid) (ATMP), nitrilo trimethylene phosphonates (NTP), ethylene diamine tetra methylene phosphonates, and diethylene triamine penta methylene phosphonates (DTPMP). The phosphonate compounds may be present either in their acid form or as salts of different cations on some or all of their acid functionalities. Preferred phosphonate chelating agents to be used herein are diethylene triamine penta methylene phosphonate (DTPMP) and ethane 1-hydroxy diphosphonate (HEDP). Such phosphonate chelating agents are commercially available from Monsanto under the trade name DEQUEST®.

Polyfunctionally-substituted aromatic chelating agents may also be useful in the compositions herein. See U.S. Pat. No. 3,812,044, issued May 21, 1974, to Connor et al. Preferred compounds of this type in acid form are dihydroxydisulfobenzenes such as 1,2-dihydroxy-3,5-disulfobenzene.

A preferred biodegradable chelating agent for use herein is ethylene diamine N,N'-disuccinic acid, or alkali metal, or alkaline earth, ammonium or substitutes ammonium salts thereof or mixtures thereof. Ethylenediamine N,N'-disuccinic acids, especially the (S,S) isomer have been extensively described in U.S. Pat. No. 4,704,233, Nov. 3, 1987, to Hartman and Perkins. Ethylenediamine N,N'-disuccinic acids is, for instance, commercially available under the tradename ssEDDS® from Palmer Research Laboratories.

Suitable amino carboxylates for use herein include ethylene diamine tetra acetates, diethylene triamine pentaacetates, diethylene triamine pentaacetate (DTPA), N-hydroxyethylethylenediamine triacetates, nitrilotri-acetates, ethylenediamine tetrapropionates, triethylenetetraamine-hexa-acetates, ethanol-diglycines, propylene diamine tetracetic acid (PDTA) and methyl glycine di-acetic acid (MGDA), both in their acid form, or in their alkali metal, ammonium, and substituted ammonium salt forms. Particularly suitable amino carboxylates to be used herein are diethylene triamine penta acetic acid, propylene diamine tetracetic acid (PDTA) which is, for instance, commercially available from BASF under the trade name Trilon FS® and methyl glycine di-acetic acid (MGDA).

Further carboxylate chelating agents for use herein include salicylic acid, aspartic acid, glutamic acid, glycine, malonic acid or mixtures thereof.

Radical Scavenger

The compositions of the present invention may further comprise a radical scavenger or a mixture thereof.

Suitable radical scavengers for use herein include the well-known substituted mono and dihydroxy benzenes and their analogs, alkyl and aryl carboxylates and mixtures thereof. Preferred such radical scavengers for use herein include di-tert-butyl hydroxy toluene (BHT), hydroquinone, di-tert-butyl hydroquinone, mono-tert-butyl hydroquinone, tert-butyl-hydroxy anysole, benzoic acid, toluic acid, catechol, t-butyl catechol, benzylamine, 1,1,3-tris(2-methyl-4-hydroxy-5-t-butylphenyl)butane, n-propyl-gallate or mixtures thereof and highly preferred is di-tert-butyl hydroxy toluene. Such radical scavengers like N-propyl-gallate may be commercially available from Nipa Laboratories under the trade name Nipanox S1®.

Radical scavengers, when used, may be typically present herein in amounts up to 10% by weight of the total composition and preferably from 0.001% to 0.5%. The presence of radical scavengers may contribute to the chemical stability of the compositions of the present invention.

Perfume

Suitable perfume compounds and compositions for use herein are for example those described in EP-A-0 957 156 under the paragraph entitled "Perfume", on page 13. The compositions herein may comprise a perfume ingredient, or mixtures thereof, in amounts up to 5.0% by weight of the total composition, preferably in amounts of 0.1% to 1.5%.

Dye

The liquid compositions according to the present invention may be coloured. Accordingly, they may comprise a dye or a mixture thereof.

Antibacterial Component

The liquid compositions according to the present invention may contain one or more antibacterial components. By "antibacterial" it is herein meant any component that kills or inactivates microorganisms selected from the group consisting of bacteria, viruses and fungi. Exemplary useful as antimicrobially active constituents are one or more cationic surfactants which are found to provide a broad antibacterial or sanitizing function. Any cationic surfactant which satisfies these requirements may be used and are considered to be within the scope of the present invention, and mixtures of two or more cationic surface active agents, viz, cationic surfactants may also be used.

Particularly useful quaternary germicides include compositions which include a single quaternary compound, as well as mixtures of two or more different quaternary compounds. Such useful quaternary compounds are available under the BARDAC®, BARQUAT®, HYAMINE®, LONZABAC®, and ONYXIDE® trademarks, which are more fully described in, for example, McCutcheon's Functional Materials (Vol. 2), North American Edition, 1998, as well as the respective product literature from the suppliers identified below. For example, BARDAC® 205M is described to be a liquid containing alkyl dimethyl benzyl ammonium chloride, octyl decyl dimethyl ammonium chloride; didecyl dimethyl ammonium chloride, and dioctyl dimethyl ammonium chloride (50% active) (also available as 80% active (BARDAC® 208M)); described generally in McCutcheon's as a combination of alkyl dimethyl benzyl ammonium chloride and dialkyl dimethyl ammonium chloride); BARDAC® 2050 is described to be a combination of octyl decyl dimethyl ammonium chloride/didecyl dimethyl ammonium chloride, and dioctyl dimethyl ammonium chloride (50% active) (also available as 80% active (BARDAC® 2080)); BARDAC®2250 is described to be didecyl dimethyl ammonium chloride (50% active); BARDAC® LF (or BARDAC® LF-80), described as being based on dioctyl dimethyl ammonium chloride (BARQUAT® MB-50, MX-50, OJ-50 (each 50% liquid) and MB-80 or MX-80 (each 80% liquid) are each described as an alkyl dimethyl benzyl ammonium chloride; BARDAC® 4250 and BARQUAT® 4250Z (each 50% active) or BARQUAT® 4280 and BARQUAT 4280Z (each 80% active) are each described as alkyl dimethyl benzyl ammonium chloride/alkyl dimethyl ethyl benzyl ammonium chloride. Also, HYAMINE® 1622, described as diisobutyl phenoxy ethoxy ethyl dimethyl benzyl ammonium chloride (50% solution); HYAMINE® 3500 (50% actives), described as alkyl dimethyl benzyl ammonium chloride (also available as 80% active (HYAMINE® 3500-80)); and HYMAINE® 2389 described as being based on methyldodecylbenzyl ammonium chloride and/or methyldodecylxylene-bis-trimethyl ammonium chloride. (BARDAC®, BARQUAT® and HYAMINE® are presently commercially available from Lonza, Inc., Fairlawn, N.J.). BTC® 50 NF (or BTC® 65 NF) is described to be alkyl dimethyl benzyl ammonium chloride (50% active); BTC® 99 is described as didecyl dimethyl ammonium chloride (50% active); BTC® 776 is described to be myrisalkonium chloride (50% active); BTC® 818 is described as being octyl decyl dimethyl ammonium chloride, didecyl dimethyl ammonium chloride, and dioctyl dimethyl ammonium chloride (50% active) (available also as 80% active (BTC® 818-80%)); BTC® 824 and BTC® 835 are each described as being of alkyl dimethyl benzyl ammonium chloride (each 50% active); BTC® 885 is described as a combination of BTC® 835 and BTC® 818 (50% active) (available also as 80% active (BTC® 888)); BTC® 1010 is described as didecyl dimethyl ammonium chloride (50% active) (also available as 80% active (BTC® 1010-80)); BTC® 2125 (or BTC® 2125 M) is described as alkyl dimethyl benzyl ammonium chloride and alkyl dimethyl ethylbenzyl ammonium chloride (each 50% active) (also available as 80% active (BTC® 2125 80 or BTC® 2125 M)); BTC® 2565 is described as alkyl dimethyl benzyl ammonium chlorides (50% active) (also available as 80% active (BTC® 2568)); BTC® 8248 (or BTC® 8358) is described as alkyl dimethyl benzyl ammonium chloride (80% active) (also available as 90% active (BTC® 8249)); ONYXIDE® 3300 is described as n-alkyl dimethyl benzyl ammonium saccharinate (95% active). (BTC® and ONYXIDE®) are presently commercially available from Stepan Company, Northfield, Ill.) Polymeric quaternary ammonium salts based on these monomeric structures are also considered desirable for the present invention. One example is POLYQUAT®, described as being a 2-butenyldimethyl ammonium chloride polymers.

Other suitable antimicrobially active constituents are selected from the group consisting of oxidizing agents such as hypochlorite and hypo bleach, disinfecting acids such as lactic, formic and citric acid, solvents and combinations thereof.

When the inventive compositions include as part of the antimicrobially active constituent one or more germicidal cationic surfactant(s), such may present in any effective amount but are advantageously included in the hard surface cleaning compositions in amounts of from about 0.001% by weight to up to about 10% by weight, very preferably about 0.01-8% by weight, more preferably in amount of between 0.5-6% by weight, and most preferably from 2-4% by weight. When such are included, it is particularly advantageous that such germicidal cationic surfactant(s) are present in amounts of at least 200 parts per million (ppm), preferably in amounts of 200-700 ppm, more preferably in amounts of from 250-500 ppm, and very especially in amount of from 3 00-500 ppm.

Delivery Form of the Compositions

The compositions herein may be packaged in a variety of suitable packaging known to those skilled in the art, such as plastic bottles for pouring liquid compositions, squeeze bottles or bottles equipped with a trigger sprayer for spraying liquid compositions. The sprayers may be of the mechanical type via a pump trigger system or an aerosol. Alternatively, the paste-like compositions according to the present invention may by packaged in a tube.

In an alternative embodiment herein, the liquid composition herein is impregnated onto a substrate, preferably the substrate is in the form of a flexible, thin sheet or a block of material, such as a sponge.

Suitable substrates are woven or non-woven sheets, cellulosic material based sheets, sponge or foam with open cell structures e.g.: polyurethane foams, cellulosic foam, melamine foam, etc.

The Process of Cleaning a Surface

The present invention encompasses a process of cleaning and/or cleansing a surface with a liquid composition according to the present invention. Suitable surfaces herein are described herein above under the heading "The liquid cleaning/cleansing composition".

In a preferred embodiment said surface is contacted with the composition according to the present invention, preferably wherein said composition is applied onto said surface.

In another preferred embodiment, the process herein comprises the steps of dispensing (e.g., by spraying, pouring, squeezing) the liquid composition according to the present invention from a container containing said liquid composition and thereafter cleaning and/or cleansing said surface.

The composition herein may be in its neat form or in its diluted form.

By "in its neat form", it is to be understood that said liquid composition is applied directly onto the surface to be treated without undergoing any dilution, i.e., the liquid composition herein is applied onto the surface as described herein.

By "diluted form", it is meant herein that said liquid composition is diluted by the user typically with water. The liquid composition is diluted prior to use to a typical dilution level of up to 10 times its weight of water. A usually recommended dilution level is a 10% dilution of the composition in water.

The composition herein may be applied using an appropriate implement, such as a mop, paper towel, brush (e.g., a toothbrush) or a cloth, soaked in the diluted or neat composition herein. Furthermore, once applied onto said surface said composition may be agitated over said surface using an appropriate implement. Indeed, said surface may be wiped using a mop, paper towel, brush or a cloth.

The process herein may additionally contain a rinsing step, preferably after the application of said composition. By "rinsing", it is meant herein contacting the surface cleaned/cleansed with the process according to the present invention with substantial quantities of appropriate solvent, typically water, directly after the step of applying the liquid composition herein onto said surface. By "substantial quantities", it is meant herein between 0.01 l and 1 l of water per $m^2$ of surface, more preferably between 0.1 l and 1 l of water per $m^2$ of surface.

In a highly preferred embodiment herein, process of cleaning is a process of cleaning household hard surfaces with a liquid composition according to present invention.

Cleaning Effectiveness Test Method:

Tiles (white enamel, 25 cm×7 cm×0.2 cm) are covered with 0.6 g of soils (0.8% wt HSW soil with Carbon Black & 6.3% Artificial body soil by Empirical Manufacturing, 83.5% Isopropyl alcohol, 9.4% Calcium Stearate, Merckx) applied to the tile via a sprayer. The soiled tiles are then dried and cooked in an oven to harden at a temperature of 140° C. for 30 mins, aged for 24 hours at room temperature (around 20° C.) in a controlled environment humidity (60-85% RH, preferably 75% RH). Then the soiled tiles are cleaned using 4 g of the compositions tested directly on a melamine foam sponge. The sponge is then mounted on a Wet Abrasion Scrub Tester Instrument (by Sheen Instruments Ltd. Kingston, England) with the composition coated side facing the tile. The abrasion tester is configured to supply pressure (200 g), and move the sponge over the test surface with a set stroke length (30 cm), at set speed (20 strokes per minute). The ability of the foam and composition to remove the polymerized grease is measured through the cleaning index which is calculated in relation to the number of cleaning cycles (cleaning strokes) to perfectly clean the surface, as determined by visual assessment, for 7 or 8 replicate cleaning runs. The lower the number of strokes, the higher the cleaning index and the cleaning ability. The delta cleaning index per surfactant or chelating acid concentration is then calculated.

EXAMPLES

These following compositions were made comprising the listed ingredients in the listed proportions (weight %). Examples 1-20 herein are meant to exemplify particles suitable in the present invention.

Abrasive particle used in the examples below were ground from foam (controlled foam structure e.g.: foam density, cell size, strut aspect ratio and % cell size content).

Examples Shaped Particle from Grinding Foam Precursor

| Example # | 1 | 2 | 3 | 4 | 5 | 6 | 7 |
|---|---|---|---|---|---|---|---|
| Raw material | $PU_{(nc)}$ | PU | PHB | PHB | PHB | PHB | PHBV |
| Particle Mean ECD (μm) | 220 | 200 | 150 | 200 | 250 | 400 | 150 |
| Packing density (kg/m$^3$) | 0.11 | 0.12 | 0.16 | 0.145 | 0.14 | 0.11 | 0.165 |

| Example # | 8 | 9 | 10 | 11 | 12 | 13 |
|---|---|---|---|---|---|---|
| Raw material | PHBV | PHBV | PHBV | PHBV | PLA | PLA |
| Particle Mean ECD (μm) | 200 | 250 | 320 | 400 | 250 | 350 |
| Packing density (kg/m$^3$) | 0.145 | 0.14 | 0.13 | 0.11 | 0.15 | 0.135 |

| Example # | 14 | 15 | 16 | 17 | 18 | 19 | 20 | 21 |
|---|---|---|---|---|---|---|---|---|
| Raw material | PLA | PCL | PCL | PBS | PBAT | PBAT | PBAT | TPS |
| Particle Mean ECD (μm) | 380 | 250 | 350 | 400 | 200 | 280 | 350 | 250 |
| Packing density (kg/m$^3$) | 0.13 | 0.145 | 0.135 | 0.145 | 0.15 | 0.14 | 0.135 | 0.145 |

Symbol raw material:

$PU_{(nc)}$ = Polyurethane BASF/Recticel

PU = compostable Polyurethane (internal synthesis from reacting 43% egg-white powder (80% albumin), 29% Poly [Propylene Glycol] (Mw 200), 0.6% Catalyst (90% water, 10% amine catalyst), 2% alkyl silicon surfactant, 13% Isocyanate ISO 126/1 (from BASF), 12% Isocyanate Lupranate T80A (from BASF).

PHB = Polyhydroxybutyrate (CAS number 26063-00-3 ex.: from Tianan or Biomer)

PHBV = Polyhydroxybutyrate-co-valerate (CAS number 80181-31-3 ex.: from Tianan or Biomer)

PLA = Polylactic acid (CAS number 26100-51-6 ex.: from NatureWorks)

PCL = Polycaprolactone (CAS number 24980-41-4 ex. from Perstorp)

PBS = Polybutylene succinate (CAS number 10034-55-6.ex.: from CSM)

PBAT = Polybutylene adipate terephtalate (CAS number 10034-55-6.ex.: from BASF)

TPS = Thermoplastic starch (CAS number 9005-25-8 e.g.: from Aldrich)

These following compositions were made comprising the listed ingredients in the listed proportions (weight %). Examples 1-10 herein are meant to exemplify the present invention but are not necessarily used to limit or otherwise define the scope of the present invention.

Examples of Abrasive-Particle Containing Formulations:

Hard surface cleaner Bathroom composition:

| % Weight | 1 | 2 | 3 |
|---|---|---|---|
| C9-C11 EO8 (Neodol 91-8 ®) | 1.95 | 1.9 | 1.5 |
| Alkyl Benzene sulfonate | | 1 | |
| C12-14-dimethyl Aminoxide | | 1 | |
| n-Butoxy Propoxy Propanol | | 2 | 2.5 |
| Hydrogene Peroxide | 3 | | |
| Hydrophobic ethoxylated polyurethane (Acusol 882 ®) | 1.5 | 1 | 0.8 |
| Lactic Acid | 3 | | 3.5 |
| Citric Acid | 0.42 | 2 | 0.48 |
| Polysaccharide (Xanthan Gum, Keltrol CG-SFT ® Kelco) | 0.25 | 0.25 | 0.25 |
| Perfume | 0.35 | 0.35 | 0.35 |
| Abrasive cleaning particle example # | 2 | 3 | 7 |
| Abrasive cleaning particle load % | 1 | 1 | 1 |
| Water (+minor e.g.; pH adjusted to 3.5) | Balance | Balance | Balance |

| % Weight | 4 | 5 | 6 | 7 |
|---|---|---|---|---|
| HCl | 2 | | | |
| C9-C11 EO8 (Neodol 91-8 ®) | | | | 1.5 |
| Linear C10 alkyl sulphate | 1.3 | 1.9 | 1.85 | 1.5 |
| n-Butoxy Propoxy Propanol | 2 | | 1.75 | 2 |
| Citric Acid | 3 | 2 | 1 | 0.48 |
| PolyvinylPyrrolidone (Luviskol K60 ®) | 0.1 | 0.1 | 0.1 | 0.1 |
| NaOH | | 0.2 | 0.2 | 0.3 |
| Perfume | 0.4 | 0.4 | 0.4 | 0.2 |
| Polysaccharide (Xanthan Gum Kelzan T ®, Kelco) | 0.3 | 0.35 | 0.35 | 0.8 |
| Abrasive cleaning particle example # | 21 | 10 | 11 | 1 |
| Abrasive cleaning particle load % | 2 | 2 | 2 | 3 |
| Water (+minor e.g.; pH adjusted to 3.1) | Balance | Balance | Balance | Balance |

| Scouring composition: | | | |
|---|---|---|---|
| % Weight | 8 | 9 | 10 |
| Sodium C13-16 prafin sulfonate | 1.95 | 1.95 | 1.95 |
| C12-14-EO7 (Lutensol AO7 ®) | 0.5 | 0.5 | 0.5 |
| Coconut Fatty Acid | 0.3 | 0.3 | 0.3 |
| Sodium Citrate | 0.33 | 0.43 | 0.48 |
| Sodium Carbonate | 3 | 3 | 3 |
| Orange terpenes | 2.1 | 2.1 | 2.1 |
| Benzyl Alcohol | 1.5 | 1.5 | |
| Polyacrylic acid 1.5 Mw | 0.75 | 0.75 | 0.75 |
| Abrasive cleaning particle example # | 1 | 7 | 20 |
| Abrasive cleaning particle load % | 5 | 5 | 5 |
| Water (+minor e.g.; pH adjusted to 7) | Balance | Balance | Balance |

TABLE I

| % Weight | I* | II | III | IV | V | VI | VII | VIII | IX | X |
|---|---|---|---|---|---|---|---|---|---|---|
| Citric acid | 0.48 | 0.48 | 0.48 | 0.48 | 0.48 | 0.48 | 0.48 | 0.48 | 0.48 | 0.48 |
| Sodium dodecylsulphate | 0 | 0 | 0 | 0 | 0 | 0.7 | 1 | 1.5 | 2 | 2.5 |
| Neodol 91.8 | 2.5 | 2 | 1.5 | 1 | 0.7 | 0 | 0 | 0 | 0 | 0 |
| Xanthan Gum | 0.8 | 0.8 | 0.8 | 0.8 | 0.8 | 0.8 | 0.8 | 0.8 | 0.8 | 0.8 |
| Abrasive particles* | 3 | 3 | 3 | 3 | 3 | 3 | 3 | 3 | 3 | 3 |
| pH to | 3 | 3 | 3 | 3 | 3 | 3 | 3 | 3 | 3 | 3 |
| Delta cleaning index/% NI/AN | 10 | 11 | 18 | 38 | 50 | 53 | 31 | 21 | 15 | 10 |

Delta cleaning index/% NI/AN 15 or less = non significant improvement

TABLE II

| % weight | XI | XII | XIII | XIV |
|---|---|---|---|---|
| Citric acid | 0.48 | 0.48 | 0.48 | 0.48 |
| Sodium dodecylsulphate | 0 | 0 | 0 | 0 |
| Neodol 91.8 | 0.7 | 0.7 | 1 | 1 |
| Xanthan Gum | 0.8 | 0.8 | 0.8 | 0.8 |
| Abrasive particles* | 0 | 3 | 0 | 3 |
| pH to | 3 | 3 | 3 | 3 |
| Cleaning Index | 6 | 69 | 6 | 81 |
| Cleaning index improvement on particulate addition | — | 63 | — | 74 |

TABLE III

| % Weight | | Ref | XV | XVI | XVII | XVIII |
|---|---|---|---|---|---|---|
| Hydrochloric acid | inorganic acid | | 0.07 | | | |
| Formic acid | organic acid | | | 0.48 | | |
| Phosphoric acid | chelating inorganic acid | | | | 0.24 | |
| Citric acid | chelating organic acid | | | | | 0.48 |
| Sodium dodecylsulphate | anionic surfactant | 0 | 0 | 0 | 0 | 0 |
| Neodol 91.8 | nonionic surfactant | 0.7 | 0.7 | 0.7 | 0.7 | 0.7 |
| Xanthan Gum | structurant | 0.8 | 0.8 | 0.8 | 0.8 | 0.8 |
| Abrasive particles* | Abrasive particle | 3 | 3 | 3 | 3 | 3 |
| pH to | | 3 | 3 | 3 | 3 | 3 |
| Improvement in cleaning vs nil acid reference (Ref) | | | = | = | ++ | ++ |

= signifying no substantial change in cleaning index

++ signifying a substantial increase in cleaning index

*Abrasive particles of Example # 1

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A liquid cleaning and/or cleansing composition comprising:

(i) abrasive cleaning particles, wherein the abrasive cleaning particles comprise a biodegradable thermoplastic material selected from the group consisting of biodegradable petroleum-based polyesters, thermoplastic starch, cellulose esters, and mixtures thereof; said biodegradable petroleum-based polyesters selected from the group consisting of polyesteramide, aliphatic copolyesters, aromatic copolyesters, and mixtures thereof;

(ii) one or more surfactants selected from the group consisting of anionic, nonionic, cationic, amphoteric and mixtures thereof; and (iii) a first acidic component wherein said acidic component consists of one or more chelating acids;

wherein at least one nonionic surfactant is comprised in said composition and the total level of nonionic surfactant is less than about 2% by weight of the total composition and/or at least one anionic surfactant is comprised in said composition and the total level of anionic surfactant is less than about 2% by weight of the total composition.

2. The liquid cleaning and/or cleansing composition according to claim 1 wherein the abrasive cleaning particles consist of particles derived from foam and the chelating acid is selected from the group consisting of citric acid, one or more salts of citric acid, citrate, one or more salts of citrate, phosphoric acid, one or more salts of phosphoric acid, tartaric acid, one or more salts of tartaric acid, oxalic acid, one or more salts of oxalic acid, maleic acid, one or more salts of maleic acid, glycolic acid, one or more salts of glycolic acid, succinic acid, one or more salts of succinic acid, glutaric acid, one or more salts of glutaric acid, adipic acid, one or more salts of adipic acid, and mixtures thereof.

3. The liquid cleaning and/or cleansing composition according to claim 1 wherein the nonionic surfactant, or the anionic surfactant, is comprised at a level of from greater than about 0% to about 1.95% by weight of the composition.

4. The liquid cleaning and/or cleansing composition according to claim 1 wherein the nonionic surfactant is selected from the group consisting of alkyl ethoxylates, alkyl polysaccharides, amine oxide, and mixtures thereof, and/or the anionic surfactant is selected from the group consisting of alkyl sulphonates, alkyl aryl sulphonates, alkyl sulphates, alkyl alkoxylated sulphates, $C_6$-$C_{20}$ alkyl alkoxylated linear or branched diphenyl oxide disulphonates, and mixtures thereof.

5. The liquid cleaning and/or cleansing composition according to claim 1 wherein the pH of the composition is from greater than about 0 to less than about 14, measured at about 20° C.

6. The liquid cleaning and/or cleansing composition according to claim 1 wherein the composition further comprises at least a second acidic component, preferably wherein said second acidic component consists of one or more non-chelating acids, more preferably selected from the group consisting of formic acid, salts of formic acid, lactic acid, salts of lactic acid, hydrochloric acid, salts of hydrochloric acid, and mixtures thereof.

7. The liquid cleaning and/or cleansing composition according to claim 1 wherein the abrasive cleaning particles are non-spherical and/or non-rolling in shape.

8. The liquid cleaning and/or cleansing composition according to claim 1, wherein said cellulose esters is selected from the group consisting of cellulose acetate and/or nitrocellulose and their derivatives.

9. The liquid cleaning and/or cleansing composition according to claim 1, wherein said composition comprises from about 0.1% to about 10% by weight of the composition of said abrasive cleaning particles.

10. The liquid cleaning and/or cleansing composition according to claim 1 further comprising a suspending aid, wherein said suspending aid is selected from the group consisting of polycarboxylate polymer thickeners; hydroxyl-containing fatty acid, fatty ester or fatty soap wax-like materials; carboxymethylcellulose, ethyl cellulose, hydroxyethyl cellulose, hydroxypropyl cellulose, hydroxymethyl cellulose, succinoglycan and naturally occurring polysaccharide polymers like Xanthan gum, gellan gum, guar gum, locust bean gum, tragacanth gum, succinoglucan gum, or derivatives thereof, or mixtures thereof.

11. A liquid cleaning and/or cleansing composition according to claim 1 wherein the cleaning composition is loaded on a cleaning substrate wherein the substrate is selected from the group consisting of paper, nonwoven towel or wipe, sponge, and combinations thereof.

12. A method of cleaning a surface, preferably soiled with a hydrophobic soil, with a composition according to claim 1, said method comprising the steps of applying said composition onto a surface, optionally allowing said composition to stand for an effective period of time, applying a mechanical action, followed by optional rinsing of the surface.

13. The method according to claim 12, wherein said surface is an inanimate surface, preferably selected from the group consisting of household hard surfaces; dish surfaces; surfaces like leather or synthetic leather; and automotive vehicles surfaces.

* * * * *